United States Patent [19]

Takeuchi et al.

[11] 4,333,777

[45] Jun. 8, 1982

[54] METHOD AND APPARATUS FOR COMPENSATING FOR LOCAL TEMPERATURE DIFFERENCE OF STEEL PRODUCT

[75] Inventors: Osamu Takeuchi, Mitaka; Kiyoshi Aoki, Chiba; Yuichi Fujii, Funabashi, all of Japan

[73] Assignee: Ishikawajima-Harima Jukogyo Kabushiki Kaisha, Tokyo, Japan

[21] Appl. No.: 161,588

[22] Filed: Jun. 20, 1980

[30] Foreign Application Priority Data

Nov. 20, 1979 [JP] Japan ..... 54-150512

[51] Int. Cl.[3] ..... C21D 11/00

[52] U.S. Cl. ..... 148/128; 148/156; 266/87

[58] Field of Search ..... 148/128, 153, 156, 144, 148/134; 266/87, 90, 96, 121, 127, 103; 432/49

[56] References Cited

U.S. PATENT DOCUMENTS

| | | | |
|---|---|---|---|
| 3,423,254 | 1/1969 | Safford et al. | 148/153 |
| 3,496,033 | 2/1970 | Gilbreath, Jr. et al. | 266/87 |
| 3,546,911 | 12/1970 | Lenz | 148/153 |
| 3,746,582 | 7/1973 | Gentry | 148/156 |
| 4,004,138 | 1/1977 | Morooka et al. | 266/87 |
| 4,223,385 | 9/1980 | Miller et al. | 266/96 |
| 4,243,441 | 1/1981 | Wilson | 148/156 |

*Primary Examiner*—Peter K. Skiff
*Attorney, Agent, or Firm*—Alfred E. Miller

[57] ABSTRACT

Method and apparatus for compensating for local temperature difference of a steel product which has been previously heated above room temperature because of the preceding operation such as rolling and which is to be heat-treated. Upper, lower and edge burners are arranged in opposed relationship with a path of travel and are selectively ignited depending upon the surface temperature distribution of the steel product detected before it enters the apparatus, in such a way that the steel product is heated uniformly to a desired temperature.

4 Claims, 6 Drawing Figures a
b1
c
b2
d
e
b3 e
d
b1
f
b2 g
a
b1
c
b2
d
h

METHOD AND APPARATUS FOR COMPENSATING FOR LOCAL TEMPERATURE DIFFERENCE OF STEEL PRODUCT

BACKGROUND OF THE INVENTION

The present invention relates to a method and apparatus for compensating in temperature or heating to required temperatures the steel products such as sheets, pipes, bars, shapes and so on when they are subjected various heat-treatments such as hardening, tempering and normalizing.

In the case of heat-treatments such as hardening, tempering and normalizing the steel products, it has been a general practice to cool the rolled steel products to room temperature and then to heat them to the required temperatures of heat-treatments.

More specifically, in the case of hardening, the steel products are once cooled and then re-heated to the hardening temperatures in a heating furnace which is exterior or outside the rolling line. That is, the heating furnace must be provided and a large amount of thermal energy is needed for reheating the steel products to be hardened. In addition, since the steel products must pass through the reheating furnace, the hardening step cannot be incorporated into the rolling line.

In the case of tempering, the steel products are once cooled to room temperature and then re-heated to the required tempering temperatures. Therefore there must be installed a reheating furnace which extends over a considerably long distance. In addition, in order to heat the steel products to be tempered from room temperature to the required tempering temperatures, a large amount of thermal energy is needed. Furthermore because of the difficulty of maintaining the hardened steel products at desired temperatures levels, they are subjected to undercooling to the temperatures below the level required for martensite transformation.

In the case of normalizing, the steel products, which have been cooled, are reheated to the normalizing temperatures. Therefore as in the case of tempering, there must be installed a reheating furnace which extends over a considerably long distance, and a large amount of thermal energy is required to heat the steel products from room temperature to the normalizing temperatures.

In view of the above, the primary object of the present invention is to provide a method and apparatus for heat-treating the steel products which may reduce the thermal energy consumption to a considerably low level hitherto never attainable by any prior art methods and apparatus.

Another object of the present invention is to provide a method and apparatus for uniformly heating to the desired temperature levels for heat-treatments the steel products even when their temperature distributions are not uniform before they are charged into the heat-treatment apparatus or installation, whereby the qualities of the steel products may be improved and the saving in labor may be attained.

The above and other objects, features and advantages of the present invention will become more apparent from the following description of a preferred embodiment thereof taken in conjunction with the accompanying drawings.

DETAILED DESCRIPTION OF THE PREFERRED EMBODIMENT

Figure 1:
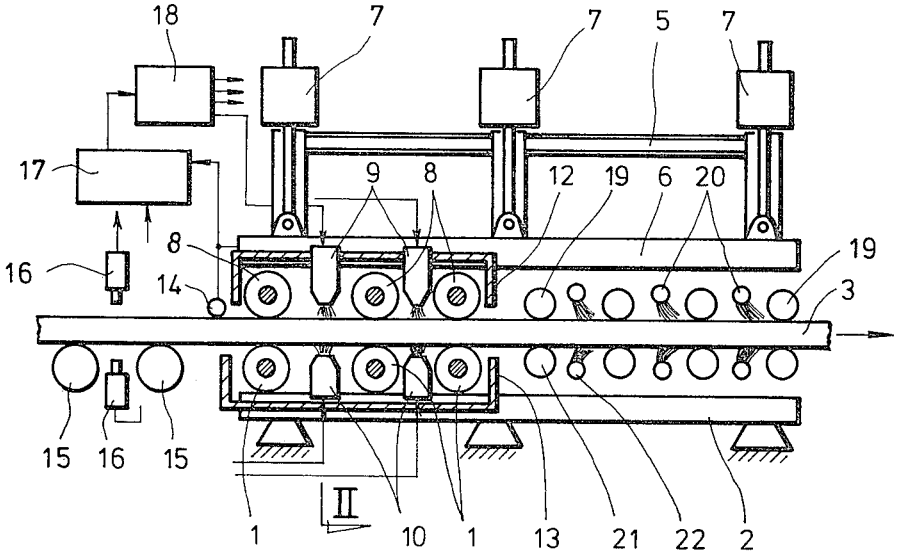
FIG. 1 is a sectional view of a temperature compensation apparatus in accordance with the present invention combined with an apparatus or installation for hardening the sheet steel.
Figure 2:
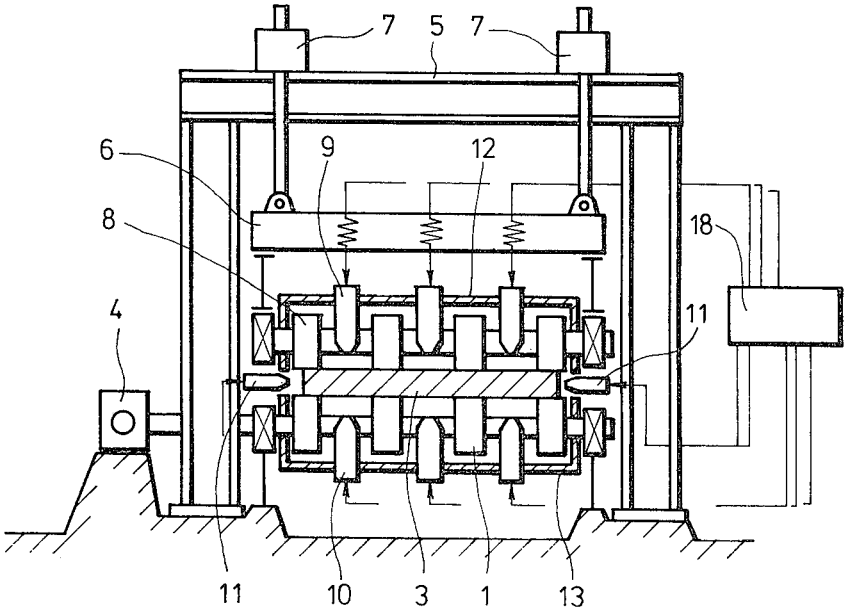
FIG. 2 is a view looking into the direction indicated by the arrow II of FIG. 1.

The present invention will be described in detail in conjunction with a process and apparatus as shown in FIGS. 1 and 2 for hardening the sheet steel, a temperature compensation apparatus of the present invention being located immediately before a hardening or quenching apparatus.

Referring to FIGS. 1 and 2, sheet steel 3 is conveyed through the temperature compensation apparatus along a path of travel defined by an array of lower rollers 1 and an array of upper rollers 8. In this embodiment, the lower-roller array includes three lower rollers 1 which are spaced apart in the longitudinal direction by a suitable distance, are rotatably mounted on a lower stationary frame 2 and are adapted to be driven by a driving device 4 such as an electric motor. Each lower roller 1 comprises a plurality of disks spaced apart from each other in the axial direction by a suitable distance as best shown in FIG. 2.

The upper-roller array which is substantially similar in construction to the lower-roller array is disposed immediately above the latter. The upper-roller array is rotatably mounted on a vertically movable frame 6 which in turn is mounted on a portal type supporting structure or frame 5. Mounted on the supporting structure or frame 5 are driving devices 7 for vertically moving the movable frame 6 and hence the upper-roller array toward or away from the lower-roller array depending upon the thickness or gage of the sheet 3 to be heat-treated.

An array of upper burners 9 is also mounted on the movable frame 6 in such a way that the upper burners 9 are located between the upper rollers 8 and the nozzles of the upper burners 9 may be spaced apart from the sheet 3 by a suitable distance when the upper rollers 8 are made into contact therewith.

An array of lower burners 10 is mounted on the stationary frame 2 in such a way that the lower burners 10 may be positioned between the lower rollers 1 and the nozzles of the lower burners 10 may be spaced apart from the traveling sheet 3 by a suitable distance when the lower rollers 1 are in contact with the sheet 3.

On both sides of the path of travel of the sheet 3 are disposed a plurality of edge burners 11 for heating the edges of the sheet 3. Therefore, the sheet 3 is rapidly heated from all sides by the upper, lower and edge burners 9, 10 and 11 which are controlled individually or in groups as will be described in more detail below.

The arrays of the upper rollers 8 and upper burners 9 and of the lower rollers 1 and lower burners 10 are surrounded by heat insulating covers 12 and 13, respectively, which in turn are mounted on the movable and stationary frames 6 and 2, respectively, but the lower and upper sides of these arrays are not covered by the heat insulating covers 12 and 13. Therefore not only the effective use of the thermal energies of the combustion products discharged from the upper, lower and edge burners 9, 10 and 11 but also the effective thermal insulation of the traveling sheet 3 may be realized.

A plurality of sheet sensors 14 which are adapted to sense the leading edge of the sheet 3, the thickness or gage and entering velocity thereof are located adjacent to the entrance to the temperature compensation apparatus and are transversely spaced apart from each other by a suitable distance. Located above and below an entrance table consisting of rollers 15 are temperature sensors 16 such as infrared cameras or optical temperature sensors for detecting the temperature distributions on both surfaces of the traveling sheet 3. These sheet and temperature sensors 14 and 16 are connected to an arithmetic and logical unit (ALU) 17 comparable in function at least to a microcomputer so that in response to the outputs from the sheet and temperature sensors 14 and 16, ALU 17 may provide various data or parameters required for uniformly heating the sheet 3 to the desired temperature. The data or parameters are the number and positions of the burners 9, 10 and 11 to be ignited and their burning time intervals which are dependent upon the difference between the surface temperatures of the sheet 3 and a reference temperature level, the size and entering velocity of the sheet 3, the interval of time elasped since the sheet 3 has been rolled and so on. The output of the arithmetic and logical unit ALU 17 is connected to a burner control unit 18 which in turn controls the upper, lower and edge burners 9, 10 and 11 individually or in groups in such a way that the difference between the surface temperature of the sheet 3 and the reference temperature becomes almost zero.

The edge burners 11, which are disposed on both sides of the path of travel of sheet 3 may be so arranged as to move toward or away from the edges of the traveling sheet 3. Sine the heat insulation covers 12 and 13 are provided to realize not only the effective utilization of the combustion products discharged from the burners 9 and 10 but also the effective heat insulation of the sheet 3, they are lined with suitable thermal insulating materials such as ceramic fibers. It is preferable to flow cooling water through the shafts of the upper and lower rollers 8 and 1 for cooling them.

The hardening or quenching apparatus which is combined with and located immediately behind or downstream of the temperature compensation apparatus in accordance with the present invention is of the roller type in which the sheet 3 emerging from the temperature compensation apparatus is conveyed along a path of travel defined between an array of longitudinally spaced upper rollers 19 and an array of also longitudinally spaced lower rollers 21, the upper and lower rollers 19 and 21 being rotatably mounted on the movable and stationary frames 6 and 2, respectively, as are the upper and lower rollers 8 and 1 of the temperature compensation apparatus. Mounted also on the movable and stationary frames 6 and 2 are upper and lower quenching medium spraying nozzles 20 and 22 which spray a suitable quenching medium such as water against the surfaces of the sheet 3 between the upper and lower rollers 19 and 21. Obviously, the upper rollers 19 and the upper nozzles 20 are vertically movable toward or away from the sheet 3 in unison with the upper rollers 8 and the upper burners 9 of the temperature compensation apparatus depending upon the thickness or gage of the sheet 3.

Next the mode of operation of the temperature compensation apparatus combined with the hardening apparatus will be described. The sheet 3 which emerges from a rolling mill (not shown) enters the temperature compensation apparatus in which the sheet 3 is heated very rapidly before it enters the hardening or quenching apparatus.

More specifically, before the sheet 3 enters the temperature compensation apparatus and is still on the entrance table 15, the temperature sensors 16 measure the upper and lower surfaces temperatures of the sheet 3, whereby the temperature distributions on the upper and lower surfaces may be obtained by the arithmetic and logical unit 17. ALU 17 determines the number and positions of the upper, lower and edge burners 9, 10 and 11 to be ignited and their burning time intervals depending upon the difference between the reference temperature and the surface temperatures of the sheet 3 detected by the temperature sensors 16, the size and entering velocity of the sheet, the time interval elasped since the sheet has passed through a preceding operation such as rolling and so on. In response to the output from the arithmetic and logical unit 17, the burner control unit 18 selects and ignites suitable upper, lower and edge burners 9, 10 and 11 so that the sheet 3, whose temperature distribution is in general not uniform and whose some local temperatures are below the desired or reference temperature, may be uniformly heated to the reference temperature before the sheet 3 leaves the temperature compensation apparatus and enters the hardening or quenching apparatus.

In addition to the outputs from the temperature sensors 16, data required for ALU 17 to make such a decision as decribed above are transmitted from suitable sensor means or the like at the preceding line and the sheet sensor 14 which senses the thickness or gage, position and entering velocity of the sheet 3. p The driving devices 7 are driven so that the upper rollers 8 and 19, the upper burners 9 and the upper water spray nozzles 20 on the movable frame 6 may be raised or lowered to a suitable height depending upon the thickness or gage of the sheet 3.

As the sheet 3 is being conveyed through the temperature compensation apparatus, the selected burners 9, 10 and 11 are ignited so that selected portions of the sheet 3 which have the local temperatures below the reference level may be heated to the reference level. As a result, the sheet 3 may be rapidly and uniformly heated to the reference or desired temperature.

The sheet 3 is conveyed between the upper and lower rollers 8 and 1 along the predetermined path of travel and the distance between the sheet 3 and the upper, lower and edge buners 9, 10 and 11 can be maintained constant and minimum so that the flames from the burners 9, 10 and 11 may impinge against the sheet 3 at faster velocities. As a result, the considerably higher heating efficiency may be ensured. The upper and lower rollers 8 and 1 also serve to prevent the damages to the burners 9, 10 and 11 due to the deformations of the sheet 3.

When the sheet 3 leaves the temperature compensation apparatus and enters the hardening or quenching apparatus, it has been heated to a temperature above an austenite transformation temperature. In the hardening or quenching apparatus, the heated sheet 3 is quenched by the quenching medium such as water sprayed under high pressure against the upper and lower surfaces of the sheet 3 through the upper and lower quenching medium spray nozzles 20 and 22. Since the spray nozzles 20 and 22 are located between the upper and lower rollers 19 and 21 and spaced apart by a suitable distance from the path of travel of the sheet 3, the damages to them by thermal or otherwise deformations of the sheet 3 may be avoided.

So far the present invention has been described in detail in conjunction with the operations for hardening the sheet steel, but it is to be understood that the present invention may be equally applied to other steel products.

Next referring to FIG. 3, some layouts of heat-treatment lines will be described. FIG. 3(A) shows a layout of a hardening line which is of the type described above with reference to FIGS. 1 and 2 and which immediately succeeds a rolling mill a in tandem. The steel product which has been heated or soaked to a suitable temperature (from 1100° to 1200° C.) enters the rolling mill a in which the steel product is further rolled into a desired shape. The rolled product is conveyed by a traveling table b to a straightener c and the straightened product is conveyed through a table $b_2$ to the temperature compensation apparatus d of the present invention in which the steel product is rapidly and uniformly heated to a temperature above an austenite transformation temperature (from 800° to 1000° C.) in the manner described above. The heated steel product is then rapidly cooled in the quenching apparatus e in the manner described above and the quenched product is conveyed by a table $b_3$ to the next line or the like. Since the rolled product is heated further and is immediately conveyed through the straightener c to the temperature compensation apparatus d, no reheating furnace is needed. In addition, the hardening line d and e may be arranged in tandem with the rolling line a.

Figures 3A, 3B, 3C:
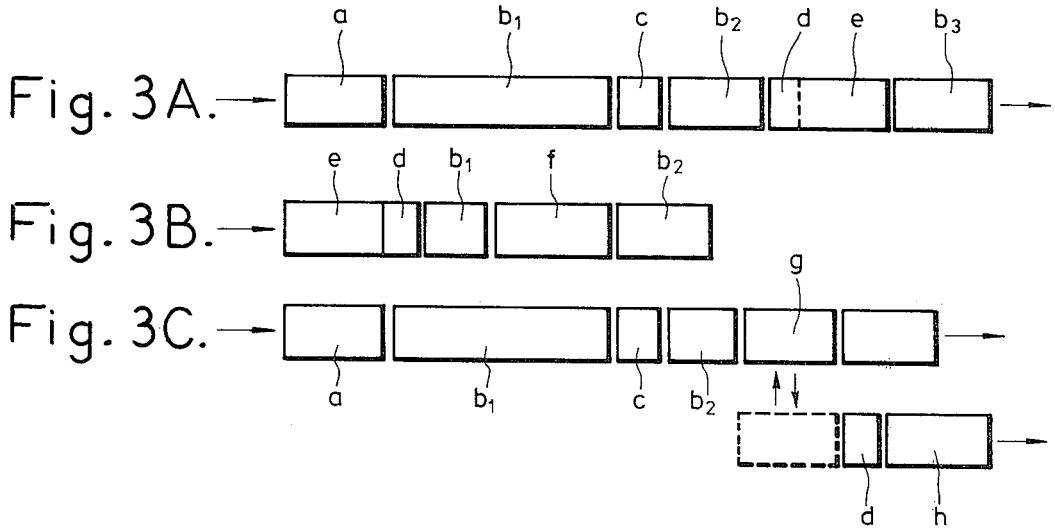
FIG. 3(A) shows a layout of a hardening line incorporating a temperature compensation apparatus in accordance with the present invention.
FIG. 3(B) shows a layout of a tempering line incorporating a temperature compensation apparatus in accordance with the present invention.
FIG. 3(C) shows a layout of a normalizing line incorporating a temperature compensation apparatus in accordance with the present invention.

FIG. 3(B) shows a layout of a tempering line. In the quenching apparatus e the steel product is rapidly cooled to a martensite transformation temperature ranging from 200° to 400° C. and the quenched product is immediately and rapidly heated to a required temering temperature (ranging from 400° to 700° C.) in the temperature compensation apparatus d of the present invention in the manner described above. The heated steel product is then conveyed by a table $b_1$ to a tempering furnace f in which the product is held at a predetermined temperature for a predetermined interval of time. The tempered steel product is then conveyed by a table $b_2$ to the next line or the like. Since the steel product is rapidly heated in the temperature compensation apparatus d, it suffices for the tempering furnace f to hold the steel product at a predetermined tempering temperature. As a result, it is not needed to add the thermal energy to the tempering furnace f so that the furnace can be made compact in size and the considerable saving in thermal energy may be attained. In addition, a roller hearth furnace or a walking beam furnace may be used as the tempering furnace f.

FIG. 3(C) shows a layout of a normalizing line. The steel product rolled by the rolling mill a is conveyed through a traveling table $b_1$, the straightener c and a table $b_2$ to a transfer table g from which the steel product is transferred to a side line or a normalizing line comprising the temperature compensation apparatus d and a normalizing furnace h. In the side line, the steel product is rapidly heated to a temperature above an austenite transformation temperature and then transferred into the normalizing furnace h in which the steel product is maintained or held at a predetermined normalizing temperature for a predetermined interval of time. As with the production line shown in FIG. 3(B), the supply of thermal energy to the normalizing furnace h is not needed so that the normalizing furnace h may be made compact in size and the considerable degree of thermal energy saving may be attained. In addition, a roller hearth furnace or a walking beam furnace may be used.

In order to demonstrate the advantages of the heat-treating lines incorporating the temperature compensation apparatus in accordance with the present invention as shown in FIGS. 3(A), 3(B) and 3(C) over the prior art heat treating lines, comparison data are shown in Table below, these data being obtained from the heat-treating operations of steel plates 25 mm in thickness.

| | hardening | | tempering | | normalizing | |
|---|---|---|---|---|---|---|
| | prior art | the invention | prior art | the invention | prior art | the invention |
| temperatures of plates prior to heating | 30° C. | 700° C. | 30° C. | 300° C. | 30° C. | 700° C. |
| heating temperature | 930° C. | 930° C. | 650° C. | 650° C. | 910° C. | 910° C. |
| heating time | 40 min | 100 sec | 60 min | 60 sec | 40 min | 100 sec |
| quantity of heat required for heating one ton of plates to heat-treating temperature | 400,00 kcal | 110,000 kcal | 260,000 kcal | 150,000 kcal | 400,000 kcal | 110,000 kcal |
| soaking time | 0 | 0 | 30 min | 30 min | 20 min | 20 min |

From the above Table it is apparent that when the temperature compensation apparatus in accordance with the present invention is incorporated into a heat-treating line for hardening, tempering or normalizing, the heating time can be considerably reduced and the heat quantity may be remarkably decreased.

Figure 4:
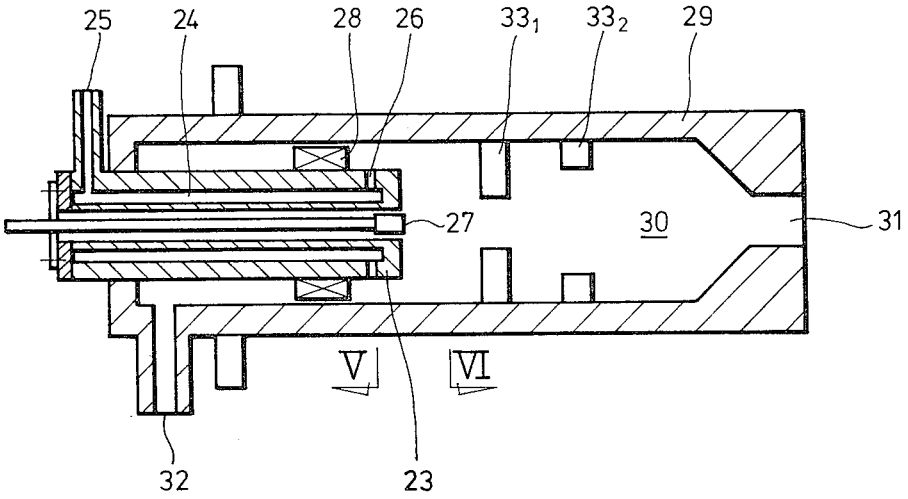
FIG. 4 is a longitudinal sectional view of a burner used in a temperature compensation apparatus in accordance with the present invention.

The upper, lower and edge burners 9, 10 and 11 preferably have such construction as will be described in detail below with reference to FIGS. 4, 5 and 6 in order to rapidly and uniformly heat the steel products. The burner has an outer hollow cylinder 29 and an inner hollow cylinder 23 extended through the bottom or end face opposite to a nozzle 31 of the outer cylinder 29 into the same coaxially thereof. The inner cylinder 26 is of the double wall construction. That is, it has coaxial outer and inner cylindrical walls with an annular or cylindrical space 24 therebetween, the front end of this space 24 being closed. The inner cylinder 26 is further formed with a gas inlet 25 communicated with the annular or cylindrical space 24 and a plurality of gas nozzles 26 drilled or otherwise formed through the outer wall in circumferentially equiangularly spaced relationship with each other adjacent to the closed front wall of the annular or cylindrical space 24. A pilot burner or an ignition plug 27 is extended through the cylindrical bore of the inner cylinder 23.

The outer cylinder 29 is lined with a suitable refractory material and is formed with the nozzle 31, an air inlet 32 opened at the cylindrical space between the outer and inner cylinders 29 and 23 adjacent to the bottom of the burner and a combustion chamber 30 defined adjacent to the nozzle 31. The outer cylinder 29 further includes an array of first baffles $33_1$ which are radially inwardly and equiangularly extended by a suitable distance into the space between the front end of the inner cylinder 23 and the nozzle 31 of the outer cylinder 29 as shown in FIGS. 4 and 6. The outer cylinder 29 further includes an array of second baffles $33_2$ which are substantially similar in arrangement with the first baffle array $33_1$. The second baffle array $33_2$ is located between the first baffle array $33_1$ and the nozzle 31 and spaced apart from the first baffle array $33_1$ by a suitable distance. The second baffles $33_2$ are slightly shorter than the first baffles $33_1$ and so arranged that, as best shown in FIG. 6, they will not overlap the first baffles $33_1$ when viewed in the direction indicated by the arrow VI in FIG. 4. The combustion chamber 30 is therefore divided into a plurality of intercommunicated compartments or the like by the first and second baffles $33_1$ and $33_2$ so that the complete combustion may be ensured.

Figure 5:
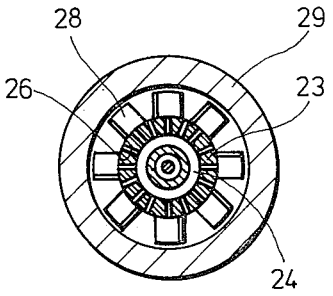
FIG. 5 is a cross sectional view taken along the line indicated by the arrow V of FIG. 4.
Figure 6:
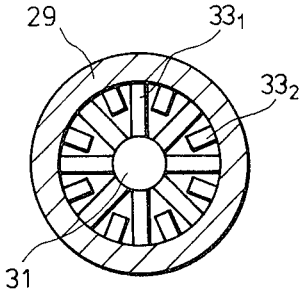
FIG. 6 is a cross sectional view taken along the line indicated by the arrow VI of FIG. 4.

A fan 28 is disposed between the outer and inner cylinders 29 and 23 as best shown in FIG. 5.

Next the mode of operation will be described. The combustion air charged through the air inlet 32 into the burner flows axially through the space between the outer and inner cylinders 29 and 23 toward the fan 28 which changes the axial flow of the combustion air into the swirling flow. A combustion gas flows from the gas inlet 25 into the space 24 and is injected through the gas nozzles 26 into the space between the outer and inner cylinder 29 and 23 just behind or downstream of the fan 28 so that the gas may be well mixed with the swirling combustion air. The combustion mixture is ignited by the pilot burner or ignition plug 27 so that the primary combustion with the very stablized flame occurs in front of the front end of the inner cylinder 23. The combustion products and the unburned combustible mixture strike against the first and then second baffle arrays $33_1$ and $33_2$ so that the swirling forces are damped and the turbulent flows result. As a consequence, the combustion is accelerated so that the complete combustion may be ensured. The combustion gas at high temperature is discharged through the nozzle 31 at a high velocity (ranging from 50 to 300 m/sec) and strikes against the steel product, whereby the latter is rapidly heated.

By virtue of the provision of the first and second baffle arrays $33_1$ and $33_2$, the combustion is accelerated or facilitated to a degree hitherto unattainable by any prior art burners so that the combustion chamber 30 may be made compact in size. In addition, a higher combustion rate higher than $10^6$ kcal/m$^3$hr is ensured. Furthermore the first and second baffle arrays $33_1$ and $33_2$ divide the combustion chamber into small chambers so that even when the effective or actual length of the combustion chamber is shortened, the pulsating combustion which produces intermittent noise at high levels and causes the vibrations of the burner may be avoided. Moreover, since the first and second baffle arrays $33_1$ and $33_2$ are provided and the second baffles $33_2$ are made shorter in length than the first baffles $33_1$, not only the extremely high temperature flames extending toward the nozzle 31 may be prevented from striking against the walls of the combustion chamber but also the swirling flows may be effectively damped.

So far the present invention has been described in detail with reference to the preferred embodiment thereof, but it is to be understood that various modifications and variations may be effected without leaving the true spirit of the present invention. For instance, the temperature compensation apparatus of the present invention may be installed behind or downstream of a continuous forging line so as to effect the temperature compensation of slabs and billets. The temperature compensation apparatus may be installed at the outlet of a heating furnace so as to eliminate surface defects such as skid marks of slabs and billets. A large number of burners with a small capacity or combustion rate on the order of from 50,000 to 300,000 kcal/hr may be arranged and only a minimum number of required burners is ignited, whereby the further saving of fuel may be attained. The output representative of the thickness or gage of a steel product from a sensor on the preceding line may be directly applied to the driving devices 7 (See FIGS. 1 and 2) so that the sheet sensor 14 (See also FIG. 1) may be used only for sensing the leading edge and entering velocity of a steel product.

The novel features and advantages of the present invention may be summarized as follows: (I) The temperature sensors 16 and ALU 17 are so combined that they may detect the portions of a steel product whose local temperatures are lower than a reference temperature and only such portions are heated by the burners 9, 10 and 11. As a consequence, the steel product can be rapidly and uniformly heated to the desired temperature with a minimum amount of thermal energy so that the qualities of the heat-treated steel product are much improved. (II) Whereas the prior art heat-treating operations heat the steel products at room temperature to the desired temperature, according to the present invention the steel products which have been heated to some level are additionally heated so that, as compared with the prior art heat-treating operations, the thermal energy can be reduced by from 50 to 75%. (III) With the temperature compensation apparatus in accordance with the present invention, the "on-line" hardening operation becomes possible and a heat-treating furnace of large size may be eliminated. As a consequence, the initial or construction cost may be reduced and the saving in thermal energy may be attained. (IV) The temperature compensation apparatus is very simple in construction and can be readily incorporated into an existing heat-treatment installation or the like. Furthermore an installation space may be reduced. (V) Since the upper burners 9 are mounted on the movable frame 6, the distance between the nozzles of the burners 9 and the upper surface of the steel product 3 may be maintained constant regardless of the thickness or gage of the steel product 3. As a result, not only the stabilized temperature compensation may be ensured but also the inspection and maintenance may be much facilitated. (VI) Since the upper and lower burners 9 and 10 are located between the rollers 8 and 1, damages to the burners due to deformations of the steel product can be avoided.

(VII) With the use of the burners of the type described with reference to FIGS. 4, 5 and 6, rapid and uniform heating can be accomplished within from 1/10 to 1/100 of the time required when the prior art burners are used. In addition, the burner installation space may be reduced. (VIII) According to the present invention, the steel products which have been previously heated and whose local temperatures vary are heated to the desired uniform temperatures. In other words, the present invention will not heat the steel products at room temperature to the desired temperatures. As a result, considerable saving in thermal energy can be obviously attained. In addition, the heat-treating furnaces can be made very compact in size.

What is claimed is:

1. An apparatus for compensating for local temperature difference of a sheet steel product comprising: an array of lower rollers which defines a path of travel of said sheet steel product, an array of upper rollers disposed in opposed relationship with said lower rollers, an array of lower burners positioned between said lower rollers, an array of upper burners positioned between said upper rollers, a vertically movable frame upon which are mounted said upper rollers and said upper burners so that the latter can be moved vertically toward or away from said path of travel depending upon the thickness or gauge of said sheet steel product, temperature sensing means for sensing the surface temperature distribution of said sheet steel product before said sheet steel product enters said apparatus, sheet sensing means for sensing the leading edge of said sheet steel product, an arithmetic and logical unit for comparing the outputs from said temperature sensing means with a reference temperature as well as responding to the output of said sheet sensing means, thereby detecting the portions of said sheet steel product whose local temperatures are below said reference temperature, and burner control means responsive to the output from said arithmetic and logical unit for selectively igniting one or more upper and lower burners, whereby said portions of said sheet steel product are heated and consequently the surface temperature of said sheet steel product is uniformly heated to said reference temperature.

2. An apparatus as set forth in claim 1 wherein nozzles of said upper burners are vertically upwardly spaced apart from a plane in contact with the bottoms of said upper roller, and the nozzles of said lower burners are vertically downwardly spaced apart from a plane of contact with the tops of said lower rollers.

3. An apparatus as set forth in claim 1 wherein each of said upper and lower burners is provided with a plurality of arrays of baffle means extended radially inwardly from a cylindrical inside wall of a combustion chamber.

4. An apparatus as set forth in claim 1 or 2 wherein said upper rollers and said upper burners are surrounded by an upper cover while said lower rollers and said lower burners are surrounded by a lower cover.

* * * * *